US009638039B2

(12) United States Patent
Ramb et al.

(10) Patent No.: US 9,638,039 B2
(45) Date of Patent: May 2, 2017

(54) VTG CARTRIDGE OF AN EXHAUST-GAS TURBOCHARGER

(75) Inventors: Thomas Ramb, Worms (DE); Dietmar Metz, Meckenheim (DE)

(73) Assignee: BorgWarner Inc., Auburn Hills, MI (US)

( * ) Notice: Subject to any disclaimer, the term of this patent is extended or adjusted under 35 U.S.C. 154(b) by 790 days.

(21) Appl. No.: 13/822,025

(22) PCT Filed: Sep. 16, 2011

(86) PCT No.: PCT/US2011/051868

§ 371 (c)(1),
(2), (4) Date: Mar. 11, 2013

(87) PCT Pub. No.: WO2012/040039

PCT Pub. Date: Mar. 29, 2012

(65) Prior Publication Data

US 2013/0170976 A1 Jul. 4, 2013

(30) Foreign Application Priority Data

Sep. 23, 2010 (DE) ..... 10 2010 046 332

(51) Int. Cl.

| | |
|---|---|
| ***F01D 5/12*** | (2006.01) |
| ***F01D 17/16*** | (2006.01) |
| *F02B 37/24* | (2006.01) |

(52) U.S. Cl.

CPC ..... *F01D 5/12* (2013.01); *F01D 17/165* (2013.01); *F02B 37/24* (2013.01); *F05D 2220/40* (2013.01); *F05D 2240/40* (2013.01)

(58) Field of Classification Search

CPC ..... F01D 17/165; F01D 5/12; F05D 2220/40; F05D 2240/40; F02B 37/24

See application file for complete search history.

(56) References Cited

U.S. PATENT DOCUMENTS

| | | | | |
|---|---|---|---|---|
| 3,171,693 | A * | 3/1965 | Gillespie, Jr. ..... | B65G 53/4633 406/67 |
| 2008/0130168 | A1* | 6/2008 | Higuchi ..... | F16C 17/107 360/99.08 |
| 2010/0209232 | A1* | 8/2010 | Stein ..... | F02C 6/12 415/148 |

FOREIGN PATENT DOCUMENTS

JP 2007205311 A * 8/2007

OTHER PUBLICATIONS

Machine Translation of JP 2007205311 A.*

* cited by examiner

*Primary Examiner* — Thai Ba Trieu
*Assistant Examiner* — Brandon Lee
(74) *Attorney, Agent, or Firm* — A. Michael Tucker; Stephan A. Pendorf; Patent Central LLC

(57) ABSTRACT

A VTG cartridge (1, 2) of an exhaust-gas turbocharger (2), with a blade bearing ring (3), and a disk (4), which is spaced apart from the blade bearing ring (3) and together with the latter delimits a hot-gas passage (5). The disk (4) is constructed from at least two layers (6, 7, 6', 7'), which bear loosely against one another in the assembled state of the disk (4).

3 Claims, 2 Drawing Sheets

VTG CARTRIDGE OF AN EXHAUST-GAS TURBOCHARGER

Figure 1:
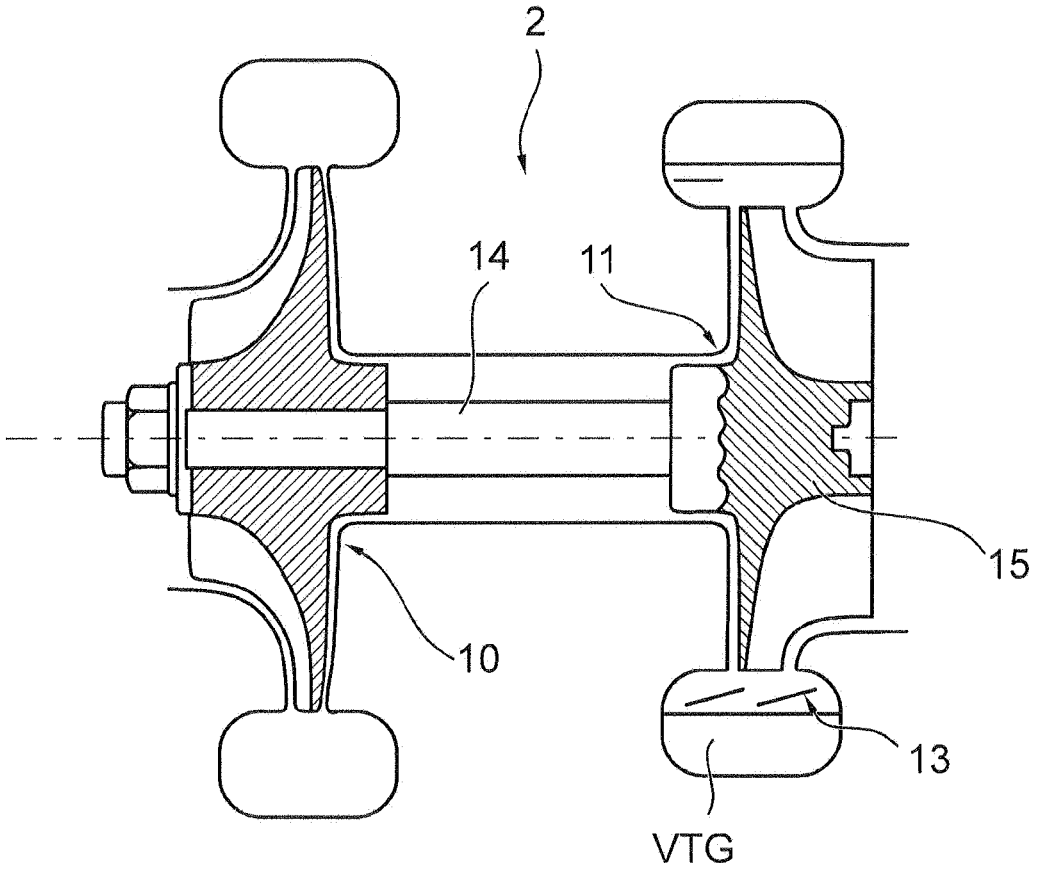

The invention relates to a VTG cartridge of an exhaust-gas turbocharger according to the preamble of claim 1.

The term "VTG cartridge" is to be understood as meaning a structural unit which comprises a blade bearing ring and a disk arranged at a distance therefrom in the turbine housing, which together delimit a hot-gas passage for guiding engine exhaust gases. A multiplicity of guide blades, which are mounted in the blade bearing ring and can be operated by way of an adjusting ring, are arranged in this hot-gas passage. The term "VTG" in this context is the common abbreviation in the art for the term "variable turbine geometry".

In known constructions, the disk and the blade bearing ring are single-part, usually CNC-rotated disks made of a homogeneous material.

A VTG cartridge which corresponds to the preamble of claim 1 is known from DE 10 2009 005 938 A1. This document provides that the disk and, if appropriate, also the blade bearing ring are composed of at least two different materials which, depending on whether they are exposed directly or indirectly to the stream of hot gas, have different coefficients of thermal expansion. In this construction, however, these two materials, which can form disks, are in turn connected to form a single-part component, for which reason they can be cast with each other, for example.

Distortion of the blade bearing ring and of the disk should be avoided here by the different coefficients of thermal expansion.

However, a disadvantage of this construction is the relatively high outlay relating to the different materials and the connection thereof to form the respective component of the disk or of the blade bearing ring.

In the light of this, it is an object of the present invention to provide a VTG cartridge of the type indicated in the preamble of claim 1 which has a simple construction and in which distortion in the axial direction is almost entirely eliminated.

This object is achieved by the features of claim 1.

This has the effect that the layers or individual disks of the disk, and if appropriate of the blade bearing ring, can radially expand freely depending on their internal temperatures, since, in contrast to the generic prior art, they are not connected to one another permanently. In turn, this has the effect that thermal stresses or deformations resulting therefrom in the axial direction can be at least considerably reduced.

The dependent claims contain advantageous developments of the invention.

As has already been mentioned above, it is possible to construct not only the disk but also the blade bearing ring from at least two layers, which bear loosely against one another in the assembled state. Of course, it is possible here for both the disk and the blade bearing ring to be constructed from more than two layers. In this context, it may prove to be advantageous if the individual layers are bound together to form bundles in order to facilitate assembly, in which case the ability of the individual layers to move is still ensured. The layers can be bound together, for example, by riveting with play or by temporary cohesion, which loses the adhesive action under thermal loading.

In this case, it is particularly advantageous that the material of the individual layers does not have to be different, since different coefficients of thermal expansion are not required for the respective layer, as the layers can radially expand independently of one another.

Figure 2:
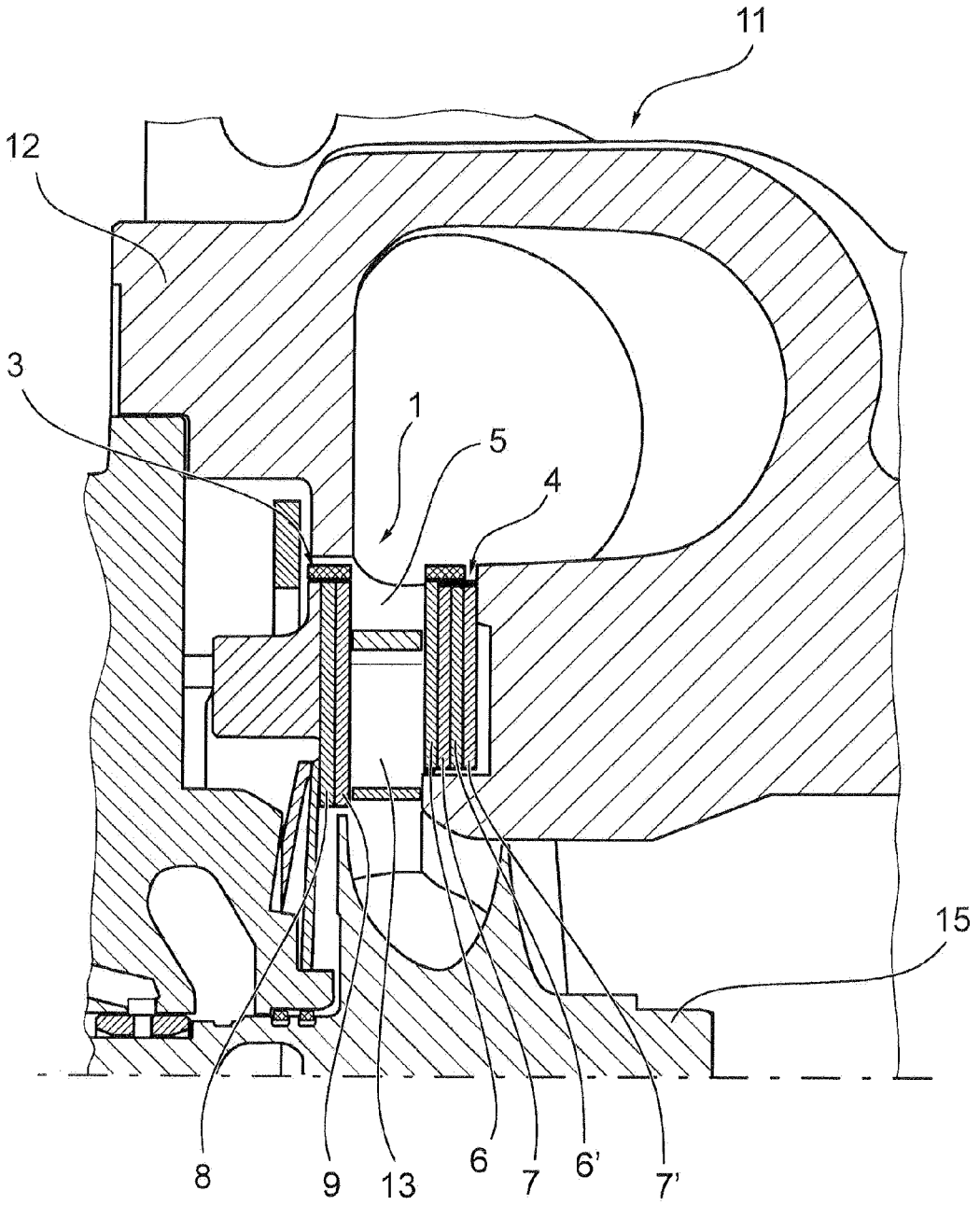

Further details, advantages and features of the present invention will become apparent from the following description of exemplary embodiments on the basis of the drawing, in which:

FIG. 1 shows a schematically greatly simplified basic illustration of a turbocharger according to the invention, and FIG. 2 shows a sectional illustration of part of a turbine housing of the exhaust-gas turbocharger according to the invention, in which there is arranged a VTG cartridge according to the invention.

Before the cartridge 1 according to the invention is described on the basis of FIG. 2, the essential components of an exhaust-gas turbocharger 2 according to the invention, in which the cartridge 1 can be incorporated, are explained hereinbelow with reference to FIG. 1.

The exhaust-gas turbocharger 2 has a compressor 10, the compressor wheel of which is connected via a shaft 14 to the turbine wheel of a turbine 11. The turbine 11 is provided with a variable turbine geometry VTG, which is indicated only schematically by guide blades 13 in FIG. 1.

The turbocharger 2 according to the invention naturally has all the other usual components which, however, do not have to be described for the explanation of the present invention. FIG. 2 shows a VTG cartridge 1 of variable turbine geometry VTG according to the invention. The cartridge 1 has a blade bearing ring 3, in which the guide blades 13 are mounted. A disk 4 is also arranged in the turbine housing 12 of the turbine 11 spaced apart from the blade bearing ring 3 in accordance with the width of the guide blades 13. The disk 4 and the blade bearing ring 3 thus delimit a hot-gas passage 5, through which engine exhaust gas flows to drive the turbine wheel 15. This stream of exhaust gas can be influenced in terms of its flow rate by the variable turbine geometry VTG by adjusting the guide blades 13.

As FIG. 2 shows, in the exemplary case the blade bearing ring 3 is constructed from two layers 8, 9, which bear loosely against one another in the assembled state shown in FIG. 2.

In the exemplary case, the disk 4 is constructed from a total of four layers 6, 7, 6' and 7', which likewise respectively bear loosely against one another; here, as mentioned in the introduction, the disk 4 can also be constructed merely from two or three such layers.

Although both the blade bearing ring 3 and the disk 4 are composed of a plurality of layers in the particularly preferred exemplary embodiment shown, it is likewise possible according to the invention for merely one of these two components to be constructed from a plurality of layers.

Since the disk 4 and/or the blade bearing ring 3 are loosely composed of a stratification of a plurality of layers, these layers 8 and 9 of the blade bearing ring 3 and, respectively, 6, 7, 6', 7' of the disk 4 can be constructed together in the turbine housing 12 such that a sliding movement which compensates for expansion is possible between the respective layers. It is therefore possible for both the blade bearing ring 3 and the disk 4 to expand as a result of different radial expansion of the layers thereof according to the thermal loading, and therefore axial distortion of the blade bearing ring 3 and/or of the disk 4 can be at least considerably reduced.

Furthermore, this loose stratification makes it possible to achieve the advantage that different materials with associated coefficients of thermal expansion, as in the prior art, are not required for the respective layers 8, 9 and 6, 7, 6', 7'.

In addition to the written disclosure of the invention, reference is hereby made explicitly to the diagrammatic illustration thereof in FIGS. 1 and 2.

LIST OF REFERENCE SYMBOLS

1 VTG cartridge
2 Exhaust-gas turbocharger
3 Blade bearing ring
4 Disk
5 Hot-gas passage
6, 7, 6', 7' Layers of the disk 4
8, 9 Layers of the blade bearing ring 3
10 Compressor
11 Turbine
12 Turbine housing
13 Guide blades of the VTG
14 Shaft
15 Turbine wheel

The invention claimed is:

1. A VTG cartridge (1, 2) of an exhaust-gas turbocharger (2), comprising:

a blade bearing ring (3), a multiplicity of guide blades adjustably mounted in the blade bearing ring (3), and a disk (4), which is spaced apart from the blade bearing ring (3), wherein the blade bearing ring (3) forms one side of a hot-gas passage (5) and the disk (4) forms the opposite side of the hot-gas passage (5), and wherein the disk (4) is constructed from at least two layers (6, 7, 6', 7') which are in sliding contact in an assembled state of the disk (4).

2. The VTG cartridge as claimed in claim 1, wherein the blade bearing ring (3) is constructed from at least two layers (8, 9), which are in sliding contact in the assembled state of the blade bearing ring (3).

3. The VTG cartridge as claimed in claim 1, wherein the layers (6, 7, 6' 7', 8, 9) are same material.

* * * * *